United States Patent [19]

Madland

[11] 4,178,857

[45] Dec. 18, 1979

[54] RAIL HOUSE CAR DOOR WEAR SKIDS

[75] Inventor: Thorvald Madland, Arlington Heights, Ill.

[73] Assignee: The Youngstown Steel Door Company, Cleveland, Ohio

[21] Appl. No.: 854,890

[22] Filed: Nov. 25, 1977

[51] Int. Cl.[2] ..... B61D 19/00; E05D 15/10

[52] U.S. Cl. ..... 105/378; 16/96 R; 49/220

[58] Field of Search ..... 105/378; 49/220, 234, 49/235; 16/93 R, 96 R, 97, 99, 107

[56] References Cited

U.S. PATENT DOCUMENTS

| | | | |
|---|---|---|---|
| 901,531 | 10/1908 | Gerdes et al. | 49/220 |
| 2,331,957 | 10/1943 | Bikle | 49/234 |
| 3,512,484 | 5/1970 | Madland et al. | 105/378 |

*Primary Examiner*—Trygve M. Blix
*Assistant Examiner*—Frank Atwood
*Attorney, Agent, or Firm*—John H. Mulholland

[57] ABSTRACT

A rail house car with side openings and doors for closing the openings by movement of the doors longitudinally along the car sides and laterally into and out of the openings. Cranks moveably support and retain the doors on longitudinal tracks below the doors and within longitudinal retainers above the doors. The cranks are selectively manually driven for lateral movement of the doors. The top cranks include combination skid and roller devices which permit the doors to move easily because of the rollers when they are longitudinally moved along the track and retainer but which permit the locating of the rollers within recesses in the surfaces of the retainers when the doors are located laterally substantially within their openings along the car sides. The skids provide minimal wear of the surfaces of the retainers when the doors are so located because of the relatively large areas of the skid surfaces in face to face engagement with the retainers' surface portions adjacent the recesses as compared to wear normally created by the rollers' tangential lines of contact with the retainers' surfaces. This wear is usually present in those situations where insufficient structural support for the roof causes vertical vibrations in the longitudinal retainers. The skid and roller combination is also associated with any auxiliary cranks which are in engagement with surfaces of the longitudinal retainers.

7 Claims, 5 Drawing Figures

RAIL HOUSE CAR DOOR WEAR SKIDS

BACKGROUND OF THE INVENTION

The invention relates to rail house cars with openings along their sides. The cars include doors for closing the openings by movement of the doors longitudinally along the sides and laterally into and out of the openings. The invention can be used in cars of the type known as all door cars having four or more door openings along each side or in some special high-cube box cars having but two door openings on each side. One function of the invention being to reduce the deleterious effect of vertical vibrations created by relatively insufficient structural support for the roofs of these cars.

There are two basic types of railroad car doors, the sliding type door and the plug type door. The present invention relates to plug type doors wherein bottom and top rotating crank means moveably support and retain the doors on longitudinal tracks below the doors and within longitudinal retainer means above the doors. Auxiliary crank means are also provided at the top door edges for increased safety. Typically, there are operating cranks opposite each other on the top and bottom edges of the door with the top crank being in association with a longitudinal retainer means and the bottom crank being in association with a longitudinal track means. These aligned cranks are tied together for unitary angular operation by means of pipes which may be selectively manually driven by various mechanical means such as levers, rack and pinion combinations, push rods and clevises, etc. In any of the types of plug doors involved, the movement of the cranks creates the lateral movement of the door into and out of the door opening, the door being "plugged" into the opening when it is laterally in the opening and free to move along the track and retainer longitudinally of the car when it is not in the "plugged" condition.

In both the multi-opening cars known as all door cars and in some special single or double opening cars known as high-cube box cars, because of vertical vibrations caused by insufficient roof support, there has been a problem of the rollers which move along and against the inside surface of the longitudinal retainer means at the top of the doors in association with the cranks damaging the inner surfaces upon which the rollers move. The rollers provide the bearing surfaces for movement of the doors along the cars; and when these rollers were fixed in position such as by the doors being plugged in a given opening, the tangential line of contact of the rollers with the inner surfaces of the longitudinal retaining means created wear. After extended use, the rollers end up gouging and frictionally eroding their way along the line of contact through the surface of the retaining means until the retaining means is weakened to a non-functional condition, either by breaking, bending or opening to the point that the rollers may not move along the longitudinal retainer surface in the manner required. The present invention is devised to eliminate or to at least minimize this action of the rollers against the surfaces of the retainer means and the resulting damage to the car created thereby due to the relative motion between the roller and the retainer means surface during movement of the rail house car.

In its simplest form, the invention relates to providing a face to face, surface to surface contact where the crank means ends engage the longitudinal retainer means as opposed to the tangent line to surface contact which has heretofor existed. To make this provision, recesses are provided in the longitudinal retaining means at the areas which most often come in contact with the crank means ends and the crank means ends have been provided with rollers surrounded by flat or slightly tapered faced skid or pad means, generally castings, which broaden the area of contact so that the crank means roller ends do not as easily damage the retainer means from friction during relative motion of the crank means and the longitudinal retaining means during movement of the house car. The means for this solution will be easily discerned from the drawings and brief description of the invention.

BRIEF DESCRIPTION OF THE INVENTION

The invention relates to the upper crank means ends on plug type doors of rail house cars wherein the generally horizontally extending crank means are retained by and are adapted for longitudinal relative motion with an inner surface of the longitudinal retaining means. The longitudinal retaining means itself is an elongated member which is mounted above the openings provided for the plug doors of a rail house car. Longitudinal retainers typically have had shapes such that they retain rollers within their generally C-shaped cross-sections so that within an inner wall or surface of the C-shape, rollers may traverse and be vertically restrained from upward and downward movement as well as from outward movement. The restraining of outward movement is accomplished by means of the rollers extending outwardly against a downwardly extending flange of the retainer which is separated from the lower end of the longitudinal retaining means by an opening through which the generally horizontal crank arm extends. The rollers extend upwardly from the horizontal crank arm such that the rollers move along the inner surface of the outer flange of the retainer means above the horizontal crank arm, thereby preventing the top portion of the door to which the crank arm is connected from lateral movement outwardly at any point along the longitudinal retainer means.

The invention adds skid surface means, skids or pads to the classic roller means, on either side thereof and above the horizontal crank arm at the top of the rotating pipe. The skid means is generally provided as an integral casting but could be special fabrication. The rollers are in engagement with the inner surface of the retainer means during longitudinal movement of the door along the car side. However, at strategic points where the door is opposite the opening into which it is to be plugged, or substantially opposite said location, the rollers because of recesses in the inner surface of the longitudinal retaining means do not contact the surface to retain the door. Instead, novel skid means on either side of each roller are in contact with the inner surface. Thus, when the door is in "plugged" condition in its opening, the door is retained from falling away from the car side at its top by means of a face to face contact of the skid means against inner surface portions of the longitudinal retainer means adjacent the recess rather than by the rollers themselves. For this reason, any motion of the rail house car which creates relative motion between the crank means and the longitudinal retainer is absorbed in the face to face frictional engagement as opposed to the rollers' tangent line to inner surface engagement. In this way, the rollers' propensity for gouging into and cutting through the retainer surface along their tangential lines of contact during relative vertical movement between the rollers and retainer surface is eliminated or at least minimized. The increased life of the longitudinal top retainers, particularly in cases of relatively insufficient structural support for the roof, thus insures proper and safer operation of the door for substantially longer periods of time.

DETAILED DESCRIPTION OF THE INVENTION

Figure 1:
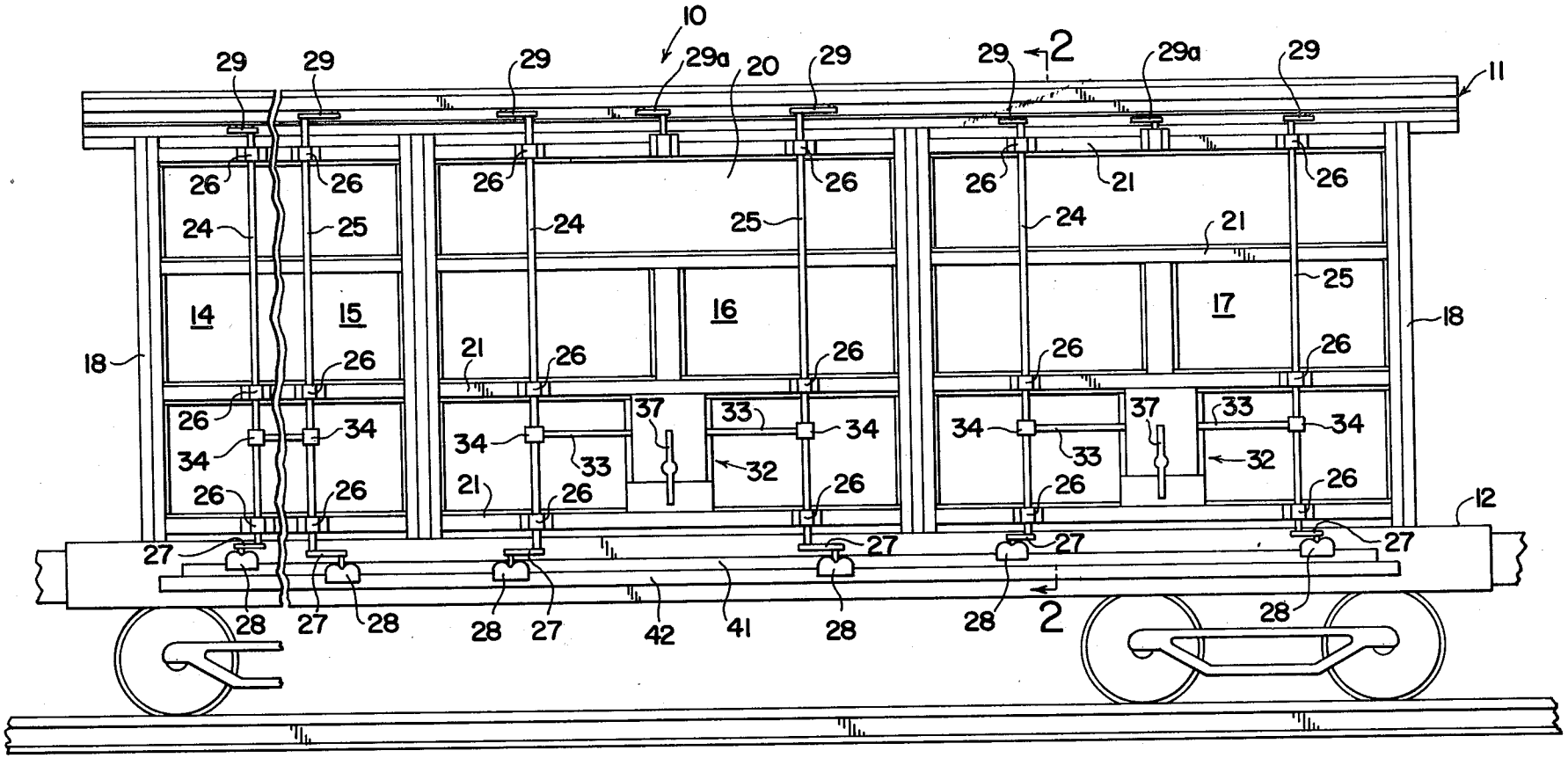
FIG. 1 is a side elevational view of a rail house car having openings along its side and plug type door utilizing rollers and wear skid surface portions according to the instant invention.
Figure 2:
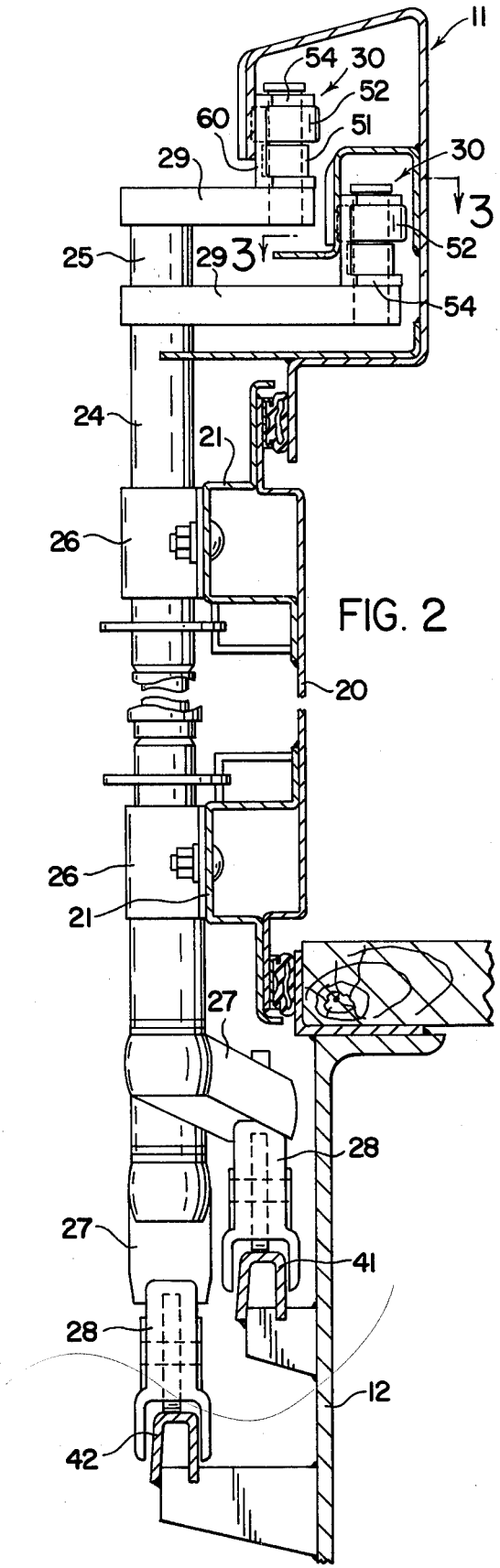
FIG. 2 is a cross-sectional view taken along the line 2—2 of FIG. 1.
Figure 3:
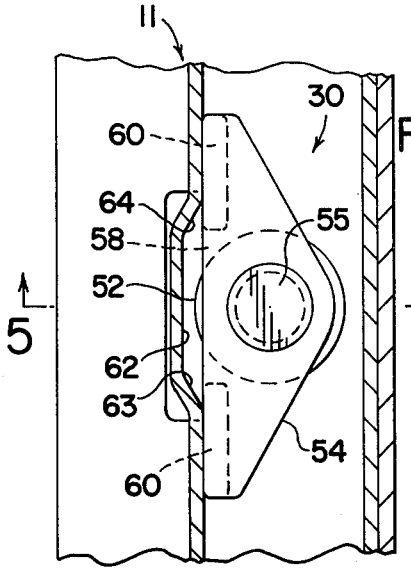
FIG. 3 is a cross-sectional view taken along the line 3—3 of FIG. 2 with the plug door laterally within a door opening in the side of the rail house car.

As can be seen in FIG. 1, a rail house car is generally designated by the numeral 10. The rail house car illustrated is of the multi-opening or all door type having positions for four plug doors, 14, 15, 16 and 17. Doors 14 and 15 are only partially shown on either side of the break in the car for purposes of illustration. Each of the plug doors is of a similar construction and includes top, center and bottom panels or sheeting 20 reinforced by horizontal channels 21 at the top and bottom thereof as well as across the center of the door. The rail house car 10 includes a side plate and retainer means generally designated by the numeral 11 and a side sill 12, each of which extends substantially along the length of the car. Each car 10 includes at least a pair of vertically extending posts 18 at spaced points adjacent opposite ends of the side sill 12 and the side plate 11 and extending therebetween.

In the illustrated car, the posts 18, side sill 12 and side plate 11 define openings in the side of the railroad car 10 which extend along substantially the entire length thereof. In this preferred form, the vertically extending posts 18 are corner posts of the car. The first and second track means, designated 41 and 42 respectively, are spaced from each other preferably both horizontally and vertically and extend along substantially the length of the car 10. The track means 41 and 42 may be secured to the side sill 12 as depicted or may be attached to the car in any other conventional fashion. Doors 14, 15, 16 and 17 are thus disposed along the side of the car 10 for closing the opening as defined by posts 18, side plate 11 and side sill 12.

As is well known to those in the industry, some of the doors, for example the doors 14 and 17, are moveably mounted on the first track means 41 and the remainder of the doors, for example the doors 15 and 16, are moveably mounted on the second track means 42. Each of the doors is capable of lateral movement into and out of the opening in the side of the car by means of a pair of pipes 24 and 25 which are rotatably secured to the face of the door through appropriate brackets 26. The pipes include upper and lower generally horizontal crank means disposed at or near each of their ends. Lower rotatable cranks 27 have roller equipped hanger means 28 at their ends which support the doors on either track 41 or track 42. Each of the pipes 24 and 25 also have upper crank means 29 and the novel roller and skid means 30 of the invention attached thereto.

The operating mechanisms generally designated by the numeral 32 include operating handles 37 and are provided for angular movement of the pipes 24 and 25 in a manner such that the doors may be moved laterally into and out of the opening. Mechanisms 32 are gear segment type devices such as are well known in the art. The rods 33 and clevises 34 make connections between mechanisms 32 and the pipes for driving the pipes and their associated cranks 27 and 29.

With this operation of the car doors in mind, a more complete description of the novel horizontal crank end roller and skid means 30 and their relationship with the side plate and retainer means 11 will be understood from the description to follow.

The illustrated crank end roller and skid means 30 extends upwardly from the generally horizontal upper crank 29 which has a bore 49 at its inner end. A roller pin 50 is received in bore 49. Mounted on roller pin 50 is an annular spacer member 51 and, above that, an anti-friction roller 52. The annular spacer member 51 and anti-friction roller 52 are mounted within the ears of a yoke, skid or casting member 54. Both the upper and lower yoke ears of member 54 have bores through which the pin 50 extends. The upper ear of yoke 54 is above the roller 52 and the lower ear is below the annular spacer 51. The entire yoke or skid member is maintained on the pin 50 by means of head 55.

The yoke 54 has an opening 58 through which roller 52 extends. Portions of the casting 54 extend on either side of the roller 52 in the longitudinal direction. These extensions form anti-friction skid surfaces, skids or pads 60. The anti-friction skids 60 are presented in face to face engagement with the inner surface of retainer 11.

Figure 4:
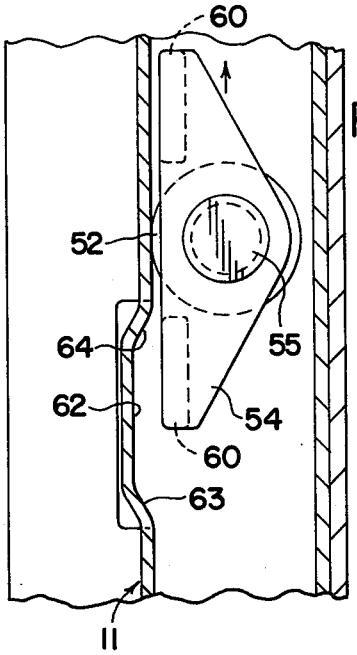
FIG. 4 is a view taken along the line 3—3 showing the door laterally removed from the door opening and partially moved along the longitudinal retainer track away from the door opening.
Figure 5:
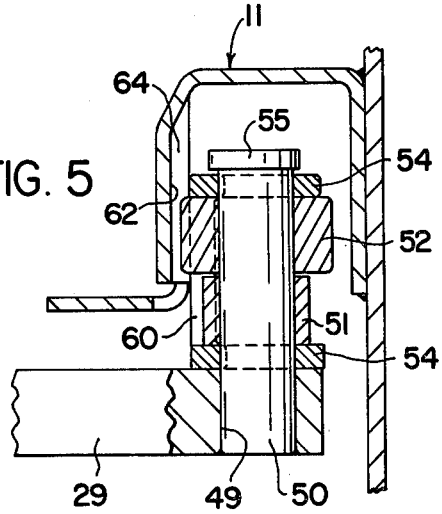
FIG. 5 is a cross-sectional view taken along the line 5—5 of FIG. 3.

When the door is laterally in front of its "plugged" position, the portion of the roller 52 extending from the opening in the yoke 54 is lined up and extends into a recess portion 62 on the inner retainer wall. The recess portion 62 has sloped sides 63 and 64 so that during travel longitudinally of the car, the roller 52 may gradually come into contact with the inner longitudinally sloping recess surfaces 63 and 64 and gradually move the skids 60 out of contact with the inner surface of the retainer 11, as seen best in FIG. 4.

It will be seen that when the door is closed or in a substantially closed position, the roller 52 is not in contact with the inner surface of the longitudinal C-shaped retainer 11 but rather the anti-friction skids 60 engage that inner surface. The roller portion 52 that would have been in contact being within the recess defined by the recess 62.

The recesses 62 along the longitudinal retainer are positioned such that when the doors are in their "plugged" condition or in position to be "plugged", the rollers are laterally aligned with the recesses and, therefore, the skids 60 are in contact with the inner surface of the longitudinal retainer. In this way, the area contact provided by the skids 60 reduces the gouging into and cutting through the inner retainer surface from that which would occur if the tangent or small area contact of the roller 52 were to be in contact with the retainer during motion of the house car.

It should be clear from this description of the invention that during movement of the doors on the tracks 41 and 42 the anti-friction rollers 52 move along the inner surface of the longitudinal retainer 11 but when the doors are at rest in the door openings only the skids 60 are in contact with the longitudinal retainer, thus limiting damage due to vibration, racking and other relative motion creating movements of the house car. The novel roller and skid means 30 are used in association with both operating crank means 29 and auxiliary crank means 29*a*, when the latter are provided as required by the Association of American Railroads and as disclosed, for example, in U.S. Pat. No. 3,913,269 assigned to the same assignee as the instant invention.

What is claimed is:

1. In a rail house car having openings along its sides, doors for closing said openings by movement along said car sides and laterally into and out of said openings, bottom and top rotating crank means moveably supporting and retaining said doors adjacent the lower portions thereof on longitudinal track means and adjacent the upper portions thereof within longitudinal retainer means, means to rotationally drive said crank means for selective lateral movement of said doors, the improvement comprising:

said top crank means adjacent the upper portion of said doors including skid means moveably engageable with the inner surface of said longitudinal retaining means when said doors are laterally substantially within said openings and roller means moveably engageable with the inner surface of said longitudinal retaining means when said doors are laterally substantially outside of said openings and free to move on said longitudinal track, thereby minimizing wear of said longitudinal retaining means by means of relative movement of said roller means and said longitudinal retaining means when said doors are laterally substantially within said openings and said rail house car is in motion.

2. The rail house car of claim 1 in which the longitudinal retaining means includes a recess into which said roller means protrudes when said doors are laterally substantially within said openings and said rail house car is in motion.

3. The rail house car of claim 2 in which the recess includes a longitudinally sloping surface merging its back wall with said inner surface of said longitudinal retaining means.

4. The rail house car of claim 1 in which said skid means of each top crank means extend longitudinally adjacent to and on either side of said roller means associated with said top crank means.

5. The rail house car of claim 4 in which the skid means are surface portions of an integral casting.

6. The rail house car of claim 1 in which a plurality of doors are provided on two longitudinal track means with each longitudinal track means having a corresponding longitudinal retainer means.

7. The rail house car of claim 1 in which each door has an auxiliary crank means in addition to its bottom and top rotating crank means and said auxiliary crank means include skid means engageable with the inner surface of said longitudinal retaining means when said doors are laterally substantially within said openings and roller means moveably engageable with the inner surface of said longitudinal retaining means when said doors are laterally outside of said openings and free to move on said longitudinal track.

* * * * *

UNITED STATES PATENT AND TRADEMARK OFFICE

CERTIFICATE OF CORRECTION

PATENT NO. : 4,178,857

DATED : December 18, 1979

INVENTOR(S) : Thorvald Madland

It is certified that error appears in the above-identified patent and that said Letters Patent are hereby corrected as shown below:

Column 5, line 24, after the words "retainer means", delete "," and insert therefor --having inner surfaces,--

Signed and Sealed this

*Twenty-fifth* Day of *March 1980*

[SEAL]

*Attest:*

SIDNEY A. DIAMOND

*Attesting Officer*

*Commissioner of Patents and Trademarks*